US007708573B2

(12) United States Patent
Takahashi

(10) Patent No.: US 7,708,573 B2
(45) Date of Patent: May 4, 2010

(54) CONNECTOR

(75) Inventor: Toshiharu Takahashi, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 144 days.

(21) Appl. No.: 11/797,700

(22) Filed: May 7, 2007

(65) Prior Publication Data

US 2007/0293070 A1 Dec. 20, 2007

(30) Foreign Application Priority Data

Jun. 20, 2006 (JP) ..... 2006-169653

(51) Int. Cl.
*H01R 13/62* (2006.01)

(52) U.S. Cl. ..... 439/157

(58) Field of Classification Search ..... 439/157, 439/341, 376, 160, 372
See application file for complete search history.

(56) References Cited

U.S. PATENT DOCUMENTS

| | | | | |
|---|---|---|---|---|
| 6,361,356 | B1 | 3/2002 | Heberlein et al. | 439/489 |
| 6,623,287 | B2 * | 9/2003 | Hatagishi et al. | 439/157 |
| 6,796,815 | B2 * | 9/2004 | Okabe et al. | 439/157 |
| 7,052,293 | B2 * | 5/2006 | Koshy et al. | 439/157 |
| 7,281,933 | B1 * | 10/2007 | Shigeta et al. | 439/157 |
| 2003/0216072 | A1 | 11/2003 | Kato et al. | 439/157 |

FOREIGN PATENT DOCUMENTS

| | | |
|---|---|---|
| DE | 102 12 852 | 1/2003 |
| EP | 1 318 570 | 6/2003 |
| JP | 11-102747 | 4/1999 |
| JP | 2001-326023 | 11/2001 |

OTHER PUBLICATIONS

Communication received from the German Patent and Trademark Office mailed Sep. 18, 2009 with English translation (7 pages).

* cited by examiner

*Primary Examiner*—Xuong M Chung-Trans
(74) *Attorney, Agent, or Firm*—Kratz, Quintos & Hanson, LLP

(57) ABSTRACT

The connector includes: a male connector; a female connector which fits to the male connector when the male connector enters inside the female connector; a lever which is rotatably attached to one of the male connector and the female connector, and rotates so as to allow the male connector and the female connector to approach or leave each other; and a pressing projection which projects from one of the lever and the female connector toward the other of the lever and the female connector, wherein when the male connector and the female connector fit to each other, the pressing projection presses the female connector in a direction in which the male connector and the female connector adhere to each other. The male and female connectors can be easily securely fit to each other, and the male and female connectors after fitting can be maintained watertight to each other.

2 Claims, 4 Drawing Sheets

CONNECTOR

BACKGROUND OF THE INVENTION (1) Field of the Invention

The present invention relates to a connector including: a male connector and a female connector which are fit to each other; and a lever rotatably provided to one of the male connector and the female connector.

(2) Description of the Related Art

So far, various types of lever-type connector have been utilized for fitting easily a male connector and a female connector to each other (for example, see Japanese Patent Application Laid-Open No. H11-102747).

A so-called lever-type connector includes: a male connector; a female connector which receives the male connector therein so as to fit to the male connector; and a lever rotatably attached to the male connector. The male connector is formed in a box-shape and attaches a packing for maintaining a watertight characteristic between the male connector and the female connector.

The female connector is formed in a box-shape. The lever rotates relative to the male connector so as to let the male and female connectors approach or leave each other. That is, the lever allows the male and female connectors to approach or leave each other so as to fit the male and female connectors to each other or separate the male and female connectors from each other.

However, as for the conventional lever-type connector described above, there has been a tendency that after the male and female connectors fit to each other, in particular, an end part of a housing of the female connector situated in the proximity of the male connector extends, said part also being a central part in the width direction of the housing of the female connector, by resilient restoring force of the packing. Therefore, it has been difficult for the conventional lever-type connector to maintain a watertight characteristic between the male and female connectors.

Moreover, as for the conventional lever-type connector described above, in order that the packing can securely maintain a watertight characteristic between the male and female connectors, it may be a good idea to increase an amount of resilient deformation of the packing upon fitting of the male and female connectors. However, in such a case, operation force required to rotate the lever upon fitting of the male and female connectors becomes stronger, causing the fitting of the connectors to be difficult or resulting in that the packing is turned up by the housing of the female connector and therefore, the packing is unable to maintain watertight characteristic between the male and female connectors.

SUMMARY OF THE INVENTION

It is therefore an objective of the present invention to solve the above problem and to provide a connector, by which the male and female connectors can be easily securely fit to each other and the male and female connectors after the fitting can be maintained watertight to each other.

In order to solve the above problem and to attain the above objective, the present invention is a connector including:

a male connector;

a female connector which fits to the male connector when the male connector enters inside the female connector;

a lever which is rotatably attached to one of the male connector and the female connector, and rotates so as to allow the male connector and the female connector to approach or leave each other; and a pressing projection which projects from one of the lever and the female connector toward the other of the lever and the female connector, wherein when the male connector and the female connector fit to each other, the pressing projection presses the female connector in a direction in which the male connector and the female connector adhere to each other.

With the construction described above, since one of the lever and the female connector is provided with the pressing projection which allows to adhere the male connector and the female connector to each other when the male connector and the female connector fit to each other, therefore the male connector and the female connector can be maintained watertight to each other after the fitting thereof without increasing an amount of resilient deformation of a packing of the male connector.

With the construction described above, the male connector and the female connector can be maintained watertight to each other after the fitting thereof without increasing an amount of resilient deformation of a packing of the male connector. Therefore, operation force required to rotate the lever upon fitting of the male and female connectors can be prevented from being stronger, and the packing can be prevented from being turned up by the female connector. Therefore, the male and female connectors can be easily securely fit to each other, and the male and female connectors after the fitting can be maintained watertight to each other.

The pressing projection is arranged at a position where the pressing projection is lined up with a central part in the width direction of the female connector in a direction crossing at right angles a fitting direction of the male connector and the female connector after the male connector and the female connector fit to each other.

With the construction described above, since the pressing projection is arranged in the proximity of the central part in the width direction of the female connector, therefore the pressing projection can securely allow the central part in the width direction of the female connector to adhere to the male connector, even if said central part tends to extend, in particular, after the male connector and the female connector fit to each other.

With the construction described above, since the pressing projection is arranged in the proximity of the central part in the width direction of the female connector, therefore the pressing projection can securely allow the central part in the width direction of the female connector to adhere to the male connector, even if said central part tends to extend, in particular, after the male connector and the female connector fit to each other. Therefore, the male and female connectors after the fitting can be maintained watertight to each other.

The pressing projection is arranged at a position where the pressing projection is lined up with an end part of the female connector in a direction crossing at right angles a fitting direction of the male connector and the female connector after the male connector and the female connector fit to each other, said end part being situated in the proximity of the male connector.

With the construction described above, since the pressing projection is arranged in the proximity of the end part of the female connector, said end part being situated in the proximity of the male connector, therefore the pressing projection can securely allow the end part of the female connector to adhere to the male connector, even if said end part tends to extend, in particular, after the male connector and the female connector fit to each other.

With the construction described above, since the pressing projection is arranged in the proximity of the end part of the female connector, said end part being situated in the proximity of the male connector, therefore the pressing projection can securely allow the end part of the female connector to adhere to the male connector, even if said end part tends to extend, in particular, after the male connector and the female connector fit to each other. Therefore, the male and female connectors after the fitting can be securely maintained watertight to each other.

DESCRIPTION OF THE PREFERRED EMBODIMENTS

Figure 1:
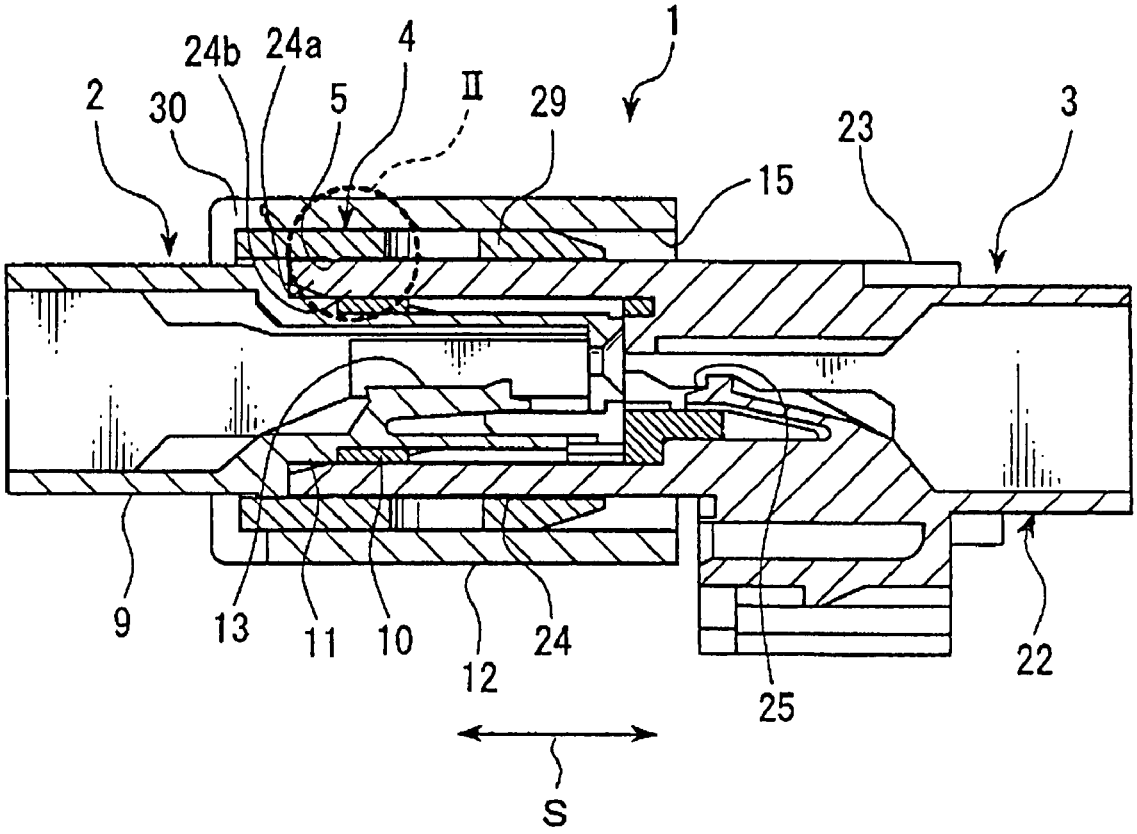
FIG. 1 is a cross sectional view of a connector according to a preferred embodiment of the present invention.

In the following, a connector according to a preferred embodiment of the present invention will be explained with reference to FIGS. 1-6. As shown in FIG. 1, a connector 1 according to a preferred embodiment of the present invention includes a male connector 2, female connector 3, lever 4 and a pair of pressing projections 5.

The male connector 2 includes a connector housing 9, female terminal fitting (hereinafter, female terminal; not shown in the figure), and packing 10. As shown in FIG. 1, the connector housing 9 includes integrally a box-shaped inner housing 11 and a tube-shaped outer cover 12. The inner housing 11 is provided with a terminal receiving chamber 13 and formed in a box-shape. Each terminal receiving chamber 13 of the inner housing 11 receives the female terminal.

The outer cover 12 is formed integrally with the inner housing 11 on a condition that the outer cover 12 receives the inner housing 11 inside. An inner surface of the outer cover 12 is situated having a distance between said inner surface and an outer surface of the inner housing 11. A pair of inner surfaces of the outer cover 12 facing each other is provided with a pair of supporting projections for the lever (not shown in the figure). The supporting projection for the lever rises up from an inner surface of the outer cover 12 toward the inside of the connector housing 9. Each supporting projection for the lever is formed in a column-shape. The supporting projections for the lever are arranged having a distance therebetween. A pair of the supporting projections for the lever is provided at a center in the width direction (i.e. in the depth direction in FIG. 1) of the male connector 2 of the outer cover 12.

Figure 2:
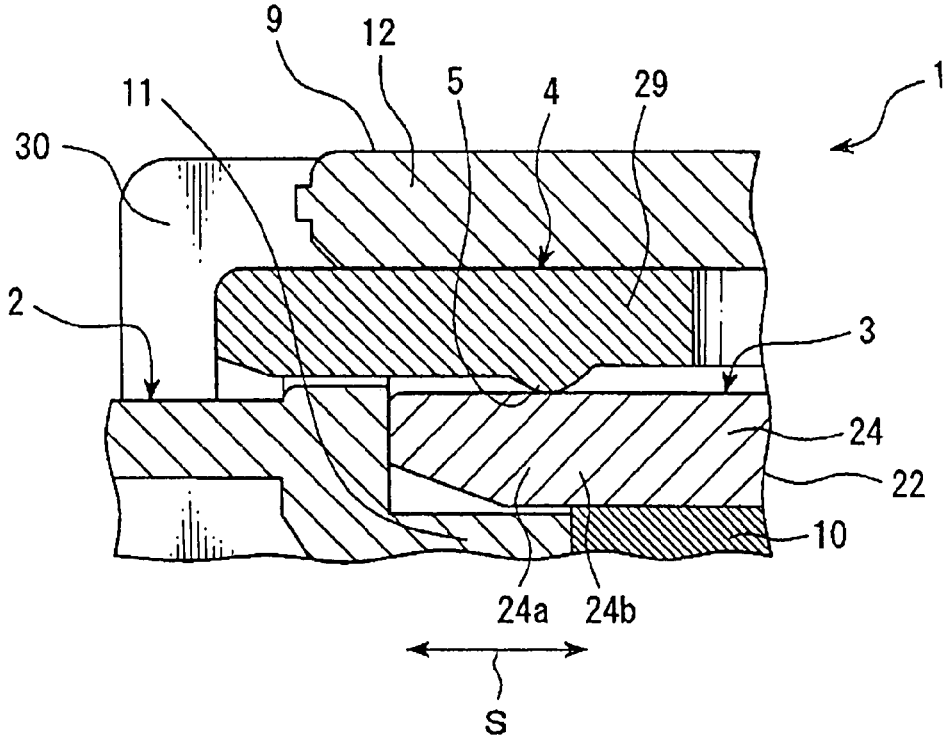
FIG. 2 is an enlarged cross sectional view of a part II in FIG. 1.

The width direction crosses at right angles a direction (shown with an arrow S in FIG. 1) in which the connectors 2 and 3 relatively move (i.e. approach and leave each other) when the connectors 2 and 3 fit to or separate from each other as explained later on. Further, the width direction is a direction in which the female terminals of the male connector 2 are lined up or a direction in which the male terminals of the female connector 3 are lined up. That is, the width direction crosses at right angles a longitudinal direction of the female terminals or the male terminals. The direction S in which the connectors 2 and 3 approach or leave each other is the fitting direction of the connectors 2 and 3. As shown in FIG. 2, the connector housing 9 is provided with a plurality of connecting ribs 15 which connect the inner cover 11 to the outer cover 12.

The packing 10 is made of resiliently deformable synthetic resin (i.e. resilient material) such as rubber. The packing 10 is formed in a ring-shape and attached to the inner housing 11 through an inside inner housing 11. The packing 10 is provided with protruding lips 16 (shown in FIG. 4) protruding toward the outside of the connector housing 9 over the whole circumference. In an example shown in the figure, three lips 16 are provided.

When the connectors 2 and 3 fit to each other, the packing 10 comes in contact with both an outer surface of the inner housing 11 of the connector housing 9 of the male connector 2 and an inner surface of a hood part 24 (explained later on) of the female connector 3 so as to maintain a watertight characteristic between said outer surface and said inner surface. That is, the packing 10 maintains a watertight characteristic between the male connector 2 and the female connector 3 when the connectors 2 and 3 fit to each other.

The connector housing 9 of the male connector 2 is provided with a locking arm which engages with a locking projection of a connector housing 22 (explained later on) of the female connector 3. When the locking arm engages with the locking projection, the male connector 2 fits to the female connector 3.

The female connector 3 includes the connector housing 22 and male terminal fitting (hereinafter, male terminal; not shown in the figure). The connector housing 22 includes integrally a box-shaped body part 23 for receiving the male terminal, mainly an electric wire connection part thereof, and tube-shaped hood part 24 for receiving the male terminal, mainly an electric contact part thereof. The body part 23 is provided with a terminal receiving chamber 25 for receiving the electric wire connection part of the male terminal. The hood part 24 is formed in a tube-shape continuing to an outer edge of the body part 23. The hood part 24 receives the inner housing 11 of the male connector 2 therein and is received in the outer cover 12 of the male connector 2.

The connector housing 22 is provided with a locking projection and fulcrum guide groove. The locking projection is formed projecting from an outer surface of the connector housing 22. The locking projection engages with the locking arm so as to fit the connectors 2 and 3 to each other.

The fulcrum guide groove is formed concave from an outer surface of a pair of outer walls of the connector housing 22, which outer walls face each other having a distance therebetween. When the connectors 2 and 3 fit to each other, a fulcrum boss 7 (explained later on) of the lever 4 enters into the fulcrum guide groove. The fulcrum boss 7, which enters in the fulcrum guide groove, is movable in the fulcrum guide groove. The fulcrum guide groove allows the connectors 2 and 3 to approach or leave each other by rotation of the lever 4 in cooperation with the fulcrum boss 7.

The hood part 24 of the connector housing 22 enters into between the inner housing 11 and the outer cover 12 of the male connector 2, and the locking projection engages with the locking arm, so that the female connector 3 fits to the male connector 2. When the connectors 2 and 3 fit to each other, the female terminal and the male terminal connect electrically to each other, so that electric wires attached to the respective terminals connect electrically to each other.

Figure 3:
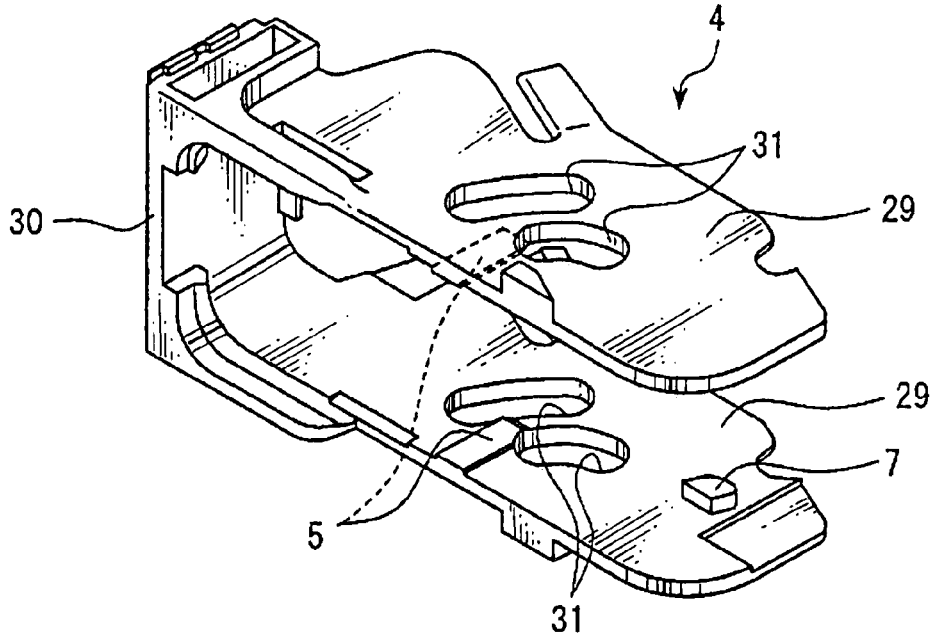
FIG. 3 is a perspective view of a lever of the connector shown in FIG. 1.

As shown in FIG. 3, the lever 4 includes a pair of flat plate parts 29 and an operation plate part 30, which connects ends of the respective flat plate parts 29 to each other, and is formed in a C-shape as a whole in its side view. Each flat plate part 29 is formed in a belt-shape. The flat plate parts 29 are arranged in parallel to each other having a distance therebetween.

Each flat plate part 29 is provided with a fulcrum boss 7 and a pair of guide holes 31. The fulcrum boss 7 is provided at an opposite end of the flat plate part 29, which opposite end does not continue to the operation plate part 30. The fulcrum boss 7 is formed in a column-shape and projects from the opposite end of the flat plate part 29 in a direction in which the flat plate parts 29 approach each other. That is, the fulcrum boss 7 is formed projecting from the flat plate part 29 toward the connector housing 22 of the female connector 3, which fits to the male connector 2.

The pair of the guide holes 31 penetrates through the flat plate part 29. The guide holes 31 are arranged having a distance therebetween and provided at a center part in both the longitudinal direction and width direction of the flat plate part 29. One guide hole 31 in its plan view has a ellipse-shape along the longitudinal direction of the flat plate part 29 in its long diameter. The other guide hole 31 in its plan view has a long hole-shape extending in an arc-shape. The other guide hole 31 bends in an arc-shape so that a center of its curvature is located on the side of the one guide hole 31.

The supporting projections for the lever enter into the respective guide holes 31. The supporting projection for the lever, which enters in the guide hole 31, is movable and rotatable in the guide hole 31. When the supporting projection for the lever enters in the guide hole 31, the lever 4 is attached to the male connector 2 being rotatable around the center part of the flat plate part 29.

When the supporting projection for the lever enters in the guide hole 31, the flat plate part 29 is arranged between the inner housing 11 and the outer cover 12. When the supporting projection for the lever rotatably moves in the guide hole 31, the flat plate part 29 is attached to the connector housing 9, that is, to the male connector 2, being rotatably around the central part thereof.

When the supporting projection for the lever enters in the guide hole 31, the lever 4 is attached to the male connector 2 having a distance between the lever 4 and the inner housing 11. Then, the lever 4 is supported by the male connector 2, being rotatably around the central part thereof. Further, when the connectors 2 and 3 fit to each other, the fulcrum boss 7 of the lever 4 enters into the fulcrum guide groove.

When the lever 4 rotates around the central part thereof with respect to the connector housing 9 of the male connector 2, the fulcrum boss 7 slides (i.e. moves and rotates) in the fulcrum guide groove so as to allow the male connector 2 and female connectors 3 to approach or leave each other. The lever 4 allows the male connector 2 and female connectors 3 to approach or leave each other so as to allow the male connector 2 and female connectors 3 to fit to or separate from each other.

As shown in FIG. 3, each pressing projection 5 is provided at a position that is the center in the longitudinal direction of the flat plate part 29 of the lever 4 and an outer edge part of the flat plate part 29 situated away from the female connector 3 when the connectors 2 and 3 fit to each other. The pressing projection 5 is formed projecting from the flat plate part 29 of the lever 4 in a direction in which the flat plate parts 29 approach each other. That is, when the connectors 2 and 3 fit to each other, the pressing projection 5 projects from the lever 4 toward the female connector 3.

When the connectors 2 and 3 fit to each other, the pressing projection 5 abuts against (or interferes with) the central part 24*b* in the width direction of the end part 24*a* of the hood part 24 of the female connector 3 near the male connector 2 so as to press the central part 24*b* toward the inner housing 11 of male connector 2. Therefore, after the connectors 2 and 3 fit to each other, as shown in FIG. 2, the pressing projection 5 is arranged at a position (or near a position) where the pressing projection 5 is lined up with the central part 24*b* in a direction crossing at right angles the direction S described above.

The connector 1 is assembled as follows: First, the female terminal attaching an electric wire is received into the connector housing 9, then the lever 4 is attached to the connector housing 9 of the male connector 2 and then, the male terminal attaching an electric wire is received into the connector housing 22 of the female connector 3, so that the connectors 2 and 3 are assembled. On this condition, the lever 4 is positioned at a position where almost the whole part of the flat plate part 29 thereof projects from between the inner housing 11 and the outer cover 12.

Figure 4:
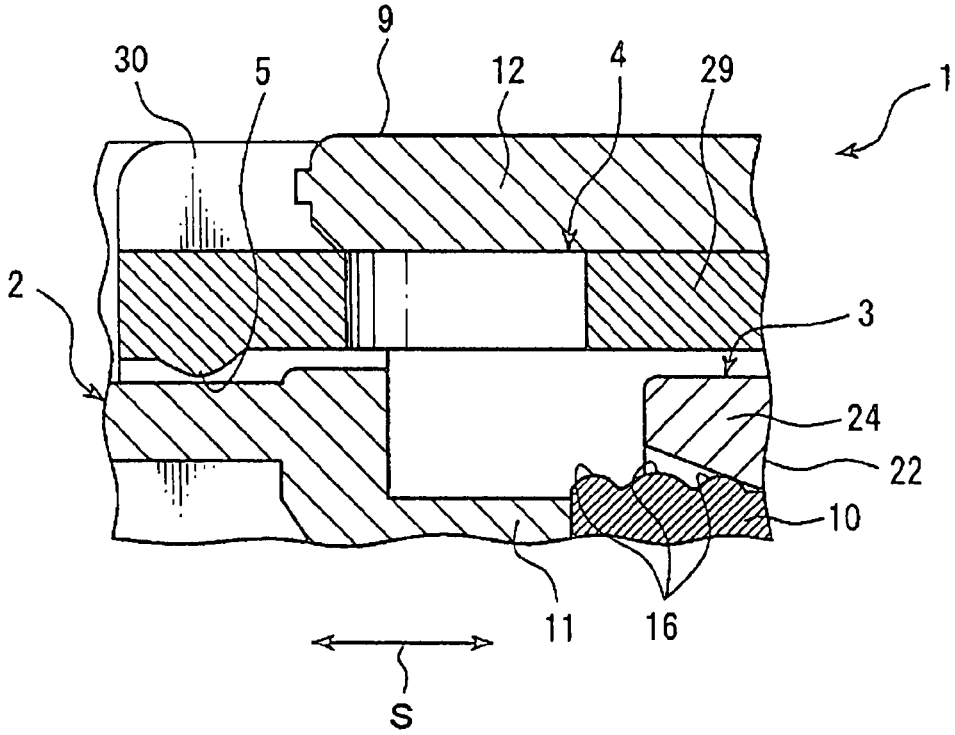
FIG. 4 is a cross sectional view illustrating a state when a male connector and a female connector of the connector shown in FIG. 2 approach each other.

Then, the connectors 2 and 3 are allowed to approach each other so as to let the fulcrum boss 7 enter into the fulcrum guide groove and as shown in FIG. 4, the inner housing 11 of the male connector 2 is inserted into the hood part 24 of the female connector 3, and the hood part 24 of the female connector 3 is inserted into the outer cover 12 of the male connector 2. Then, the operation plate part 30 of the lever 4 is pressed, and the lever 4 is rotated in a direction in which almost the whole part of the flat plate part 29 of the lever 4 disappears between the inner housing 11 and the outer cover 12.

Figure 5:
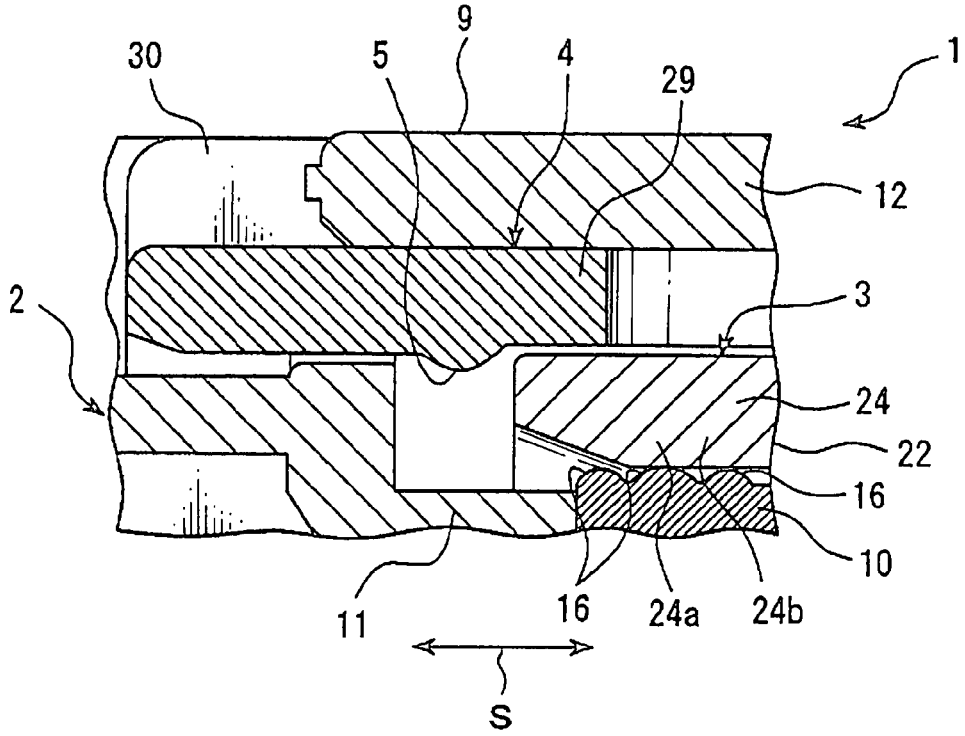
FIG. 5 is a cross sectional view illustrating a state when the male connector and the female connector shown in FIG. 4 further approach each other.

Then, the fulcrum boss 7 slides in the fulcrum guide groove, so that the connectors 2 and 3 approach each other as shown in FIG. 5. Then, the pressing projection 5 abuts against (or interferes with) the central part 24*b* of the end part 24*a* of the hood part 24 of the female connector 3 so as to press the central part 24*b* toward the inner housing 11 of male connector 2.

Figure 6:
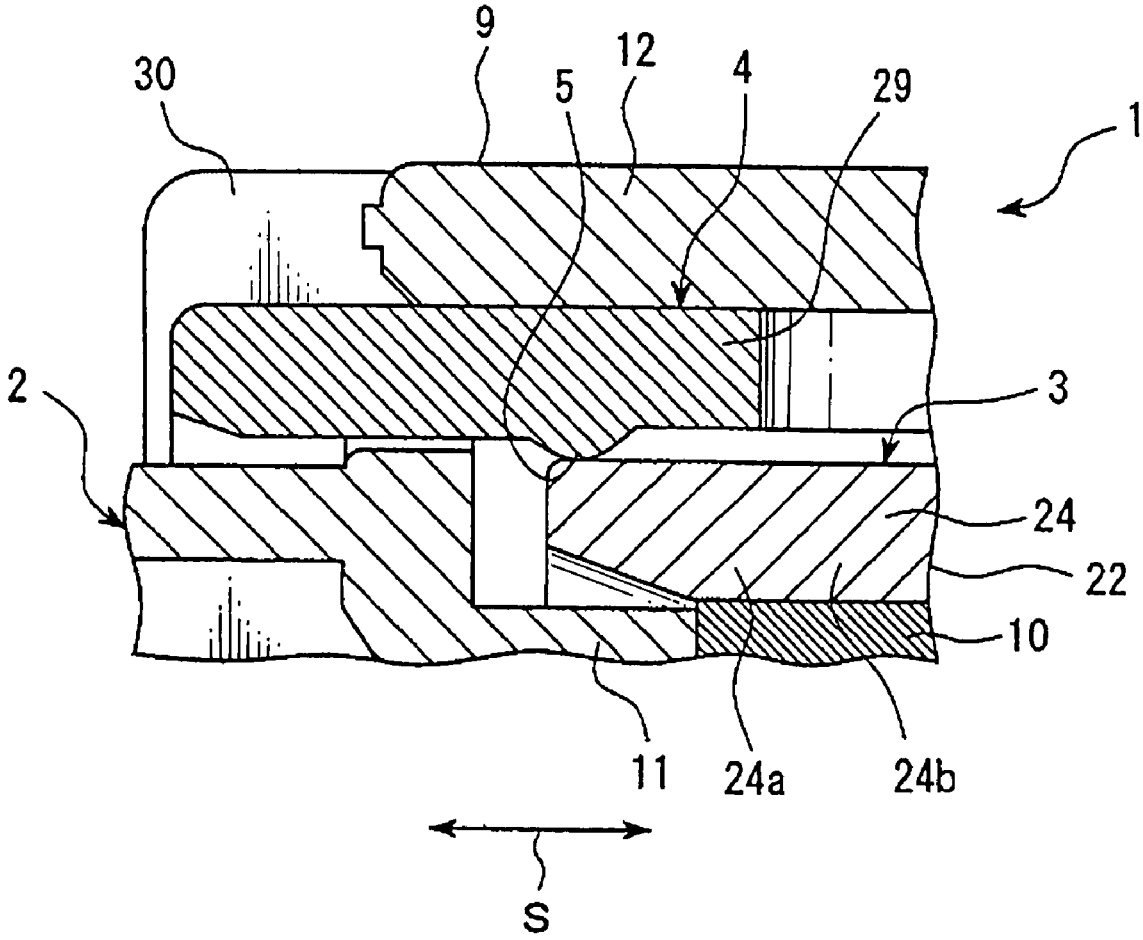
FIG. 6 is a cross sectional view illustrating a state when a pressing projection of a lever shown in FIG. 5 presses an end part of a hood part of the female connector.

Then, as shown in FIG. 6, the pressing projection 5 presses the hood part 24 of the female connector 3 in a direction in which the hood part 24 adheres to the inner housing 11 of the male connector 2, so that mainly the lips 16 of the packing 10 is resiliently deformed. Then, as shown in FIGS. 1 and 2, the locking projection and the locking arm fit to each other, and the connectors 2 and 3 fit to each other, so that the connector 1 is assembled.

As shown in FIG. 2, on a condition that the connectors 2 and 3 fit to each other, of course, the pressing projection 5 presses the central part 24*b* of the end part 24*a* of the hood part 24 toward the inner housing 11 of the male connector 2. Thus, when the connectors 2 and 3 fit to each other, the pressing projection 5 presses the female connector 3 in a direction in which the female connector 3 adheres to the male connector 2. When the connectors 2 and 3 are to be separated from each other, the lever 4 is rotated in the reverse direction.

According to the preferred embodiment, the lever 4, which is selected from the lever 4 and the female connector 3, is provided with the pressing projection 5 which lets the connectors 2 and 3 adhere to each other when the connectors 2 and 3 fit to each other. Therefore, even if the amount of the resilient deformation of the packing 10 of the male connector 2 is not increased, the pressing projection 5 lets the connectors 2 and 3 adhere to each other so that the packing 10 can adhere to both connectors 2 and 3. That is, the connectors 2 and 3 can adhere to each other after the fitting thereof so as to maintain a watertight characteristic between the connectors 2 and 3, without increasing the amount of the resilient deformation of the packing 10 of the male connector 2.

Therefore, the operation force of the lever 4, which force is necessary for the rotation thereof upon fitting of the connectors 2 and 3, can be prevented from increasing, and the packing 10 can be prevented from being turned up by the female connector 3. Since the operation force of the lever 4 is not increased, the connectors 2 and 3 can be easily fitted to each other. Since the packing 10 is not turned up, a watertight characteristic between the connectors 2 and 3 after the fitting thereof can be securely maintained.

Since the pressing projection 5 is arranged in the proximity of the central part 24*b* in the width direction of the hood part 24 of the female connector 3, therefore the pressing projection 5 can securely let the central part 24*b*, which particularly tends to extend after the fitting of the connectors 2 and 3, to adhere to the inner housing 11 of the male connector 2. That is, a watertight characteristic between the connectors 2 and 3 after the fitting thereof can be securely maintained.

Since the pressing projection 5 is arranged in the proximity of the end part 24*a* of the hood part 24 of the female connector 3, said end part 24*a* being situated near to the male connector 2, therefore the pressing projection 5 can securely let the end part 24*a*, which particularly tends to extend after the fitting of the connectors 2 and 3, to adhere to the inner housing 11 of the male connector 2. That is, a watertight characteristic between the connectors 2 and 3 after the fitting thereof can be securely maintained.

In the preferred embodiment described above, the lever 4 is attached to the male connector 2. However, instead, the lever 4 may be attached to the female connector 3. Further, in the preferred embodiment described above, the pressing projection 5 is provided at the lever 4. However, instead, the pressing projection 5 may be provided at the hood part 24 of the connector housing 22 of the female connector 3.

In the preferred embodiment described above, the pressing projection 5 is arranged at a position where the pressing projection 5 is lined up with a central part 24*b* in the width direction of the end part 24*a* of the hood part 24 of the female connector 3 in a direction crossing at right angles the direction S, in which the connectors 2 and 3 approach or leave each other. However, the pressing projection 5 may not be arranged at a position where the pressing projection 5 is lined up with a central part 24*b* in the width direction of the end part 24*a* of the hood part 24 of the female connector 3 in a direction crossing at right angles the direction S, in which the connectors 2 and 3 approach or leave each other.

The aforementioned preferred embodiments are described to aid in understanding the present invention and variations may be made by one skilled in the art without departing from the spirit and scope of the present invention.

What is claimed is:

1. A connector comprising:

a male connector;

a female connector which fits to the male connector when the male connector enters inside the female connector;

a C-shaped lever, having a pair of flat plate parts and an operation plate part connecting the ends of the flat plate parts to each other, which is rotatably attached to one of the male connector and the female connector, and rotates so as to allow the male connector and the female connector to approach or leave each other; and a pressing projection which projects from one of the flat plate part of the lever and the female connector toward the other of the lever and the female connector, the pressing projection extended from an outer edge of a center of the longitudinal direction of the flat plate part, wherein when the male connector and the female connector fit to each other, the pressing projection presses the female connector in a direction in which the male connector and the female connector adhere to each other, and wherein the pressing projection is arranged at a position where the pressing projection is lined up with a central part in the width direction of the female connector in a direction crossing at right angles a fitting direction of the male connector and the female connector after the male connector and the female connector fit to each other.

2. The connector according to claim 1, wherein the pressing projection is arranged at a position where the pressing projection is lined up with an end part of the female connector in a direction crossing at right angles a fitting direction of the male connector and the female connector after the male connector and the female connector fit to each other, said end part being situated in the proximity of the male connector.

* * * * *